US007971320B2

(12) United States Patent
Fain et al.

(10) Patent No.: US 7,971,320 B2
(45) Date of Patent: Jul. 5, 2011

(54) DOOR HINGE ASSEMBLY

(75) Inventors: Charles R. Fain, Macomb Township, MI (US); Arthur S. Hipkiss, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 33 days.

(21) Appl. No.: 11/972,644

(22) Filed: Jan. 11, 2008

(65) Prior Publication Data

US 2009/0178241 A1 Jul. 16, 2009

(51) Int. Cl.
*E05D 3/06* (2006.01)

(52) U.S. Cl. ..... 16/366

(58) Field of Classification Search ..... 16/366, 16/272, 254, 260, 261, 292, 297, 342; 296/146.1, 296/146.11
See application file for complete search history.

(56) References Cited

U.S. PATENT DOCUMENTS

| | | | | |
|---|---|---|---|---|
| 4,744,290 | A * | 5/1988 | Josephson | 454/333 |
| 4,819,298 | A * | 4/1989 | Lautenschlager | 16/237 |
| 5,611,114 | A * | 3/1997 | Wood et al. | 16/366 |
| 6,175,991 | B1 * | 1/2001 | Driesman et al. | 16/366 |
| 6,591,452 | B2 * | 7/2003 | Jacquin | 16/332 |
| 6,647,592 | B2 * | 11/2003 | Presley | 16/366 |
| 6,681,448 | B2 * | 1/2004 | Liang | 16/336 |
| 6,942,277 | B2 * | 9/2005 | Rangnekar et al. | 296/146.11 |
| 7,114,219 | B2 * | 10/2006 | Kiefer et al. | 16/366 |

* cited by examiner

*Primary Examiner* — Victor Batson
*Assistant Examiner* — Matthew Sullivan

(57) ABSTRACT

A hinge assembly for opening and closing a door that provides access to the interior of a motor vehicle body is disclosed. The hinge assembly includes a body-side hinge strap secured to the body and providing a first axis, a door-side hinge strap secured to the door and providing a second axis spaced laterally from the first axis, a hinge mid-strap supported on the body-side hinge strap to pivot about the first axis and being pivotably supported on the door-side hinge strap at the second axis, and a lockout bracket secured to the door-side hinge strap and secured to the hinge mid-strap at a location between the first axis and second axis for preventing the door from pivoting about the second axis.

13 Claims, 6 Drawing Sheets

DOOR HINGE ASSEMBLY

BACKGROUND OF INVENTION

The present invention relates generally to a vehicle door hinge, and, more particularly, to a bracket in the door hinge assembly that limits the angular displacement of the door when in its open position.

A vehicle chassis cab, such as an extended cab for a pickup truck, may be up-fitted with a wide body, such as a flat bed or a camper, that extends laterally beyond the outer surface of the cab. The rear doors of the cab (the RAP doors) are hinged such that they swing rearward in an angular range of about 170 degrees in order to improve access to the cab in pickup truck applications. When this vehicle chassis cab is used with a wide body, however, this range of door travel allows the door to contact the wide body, and that contact may damage the outer sheet metal on the door assembly.

Frequently the wide vehicle body is retrofitted to the vehicle chassis at a location other than the assembly plant where the vehicle chassis is assembled. Therefore, original equipment that would limit the range of door travel and prevent damage to the door is not known to be required and is not installed at the assembly plant. Moreover, it is not desirable to limit the opening angle for the pickup truck applications of this chassis.

A need exists, therefore, for a technique to adapt the door hinge originally installed in the vehicle, such that the door travel is limited to an angular range within which contact between the door, while being opened, and the retrofitted, wide body is prevented.

SUMMARY OF INVENTION

An embodiment contemplates a hinge assembly for opening and closing a door that provides access to the interior of a motor vehicle body. The hinge assembly includes a body-side hinge strap secured to the body and defining a first axis, a door-side hinge strap secured to the door and defining a second axis spaced laterally from the first axis, a hinge mid-strap supported on the body-side hinge strap to pivot about the first axis and being pivotably supported on the door-side hinge strap at the second axis, and a lockout bracket secured to the door-side hinge strap and secured to the hinge mid-strap at a location between the first axis and the second axis for preventing the door from pivoting about the second axis.

The lockout bracket, which can be added to a vehicle door hinge at a vehicle dealership or up-fitter, reduces the angular range of door travel from about 170 degrees to about 90 degrees. The lockout brackets eliminate the need for an additional hinge assembly, thereby saving cost, eliminating design complexity and minimizing installation time.

An embodiment contemplates a method for reliably restricting the angular range of door travel on a vehicle such that contact between the door and a specialized, unusually wide vehicle body is prevented.

DETAILED DESCRIPTION

Figure 1:
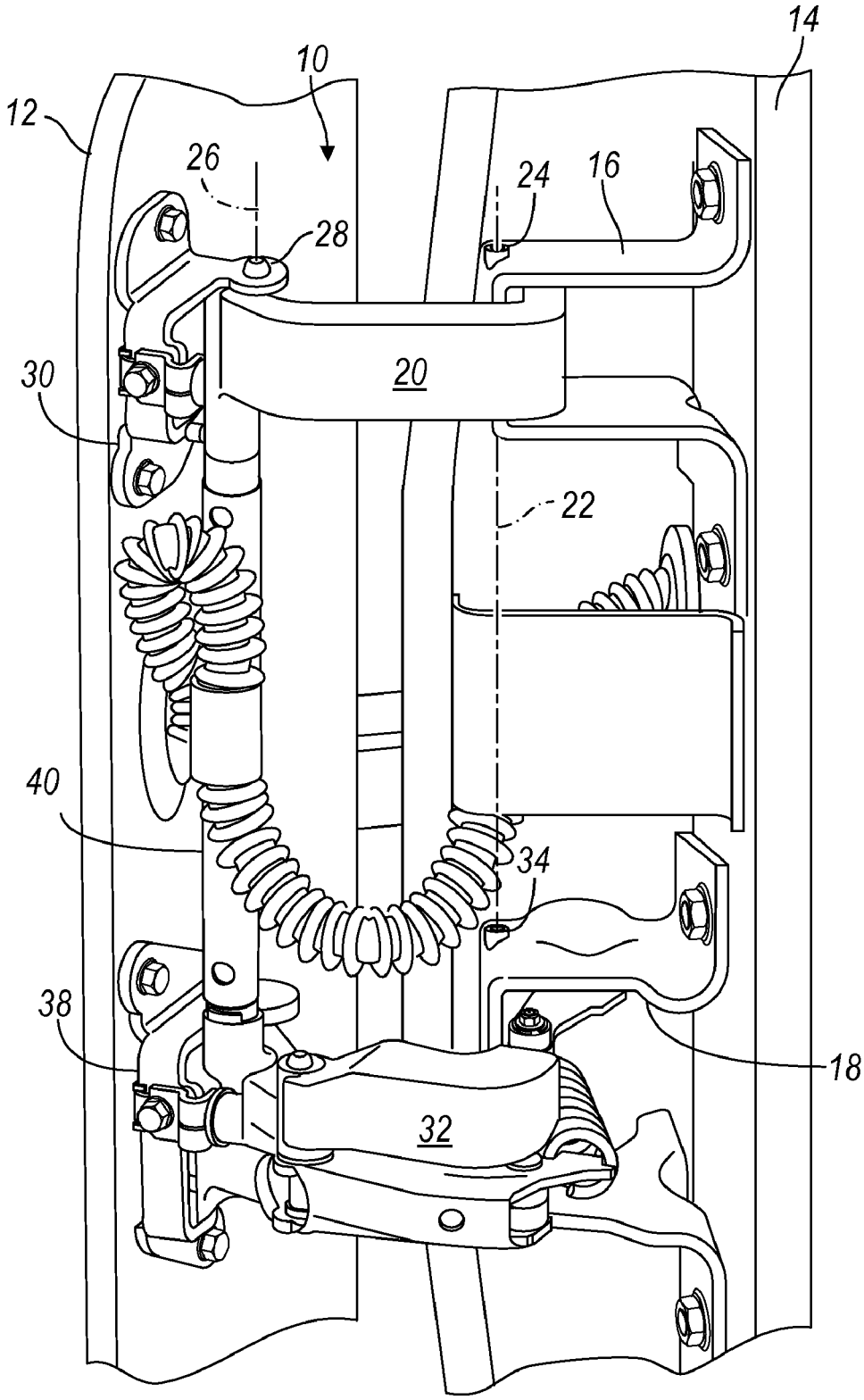
FIG. 1 is a perspective view of a door hinge assembly, installed at the right hand, rear door of an extended cab, that limits angular displacement of the door to the full open position.
Figure 2:
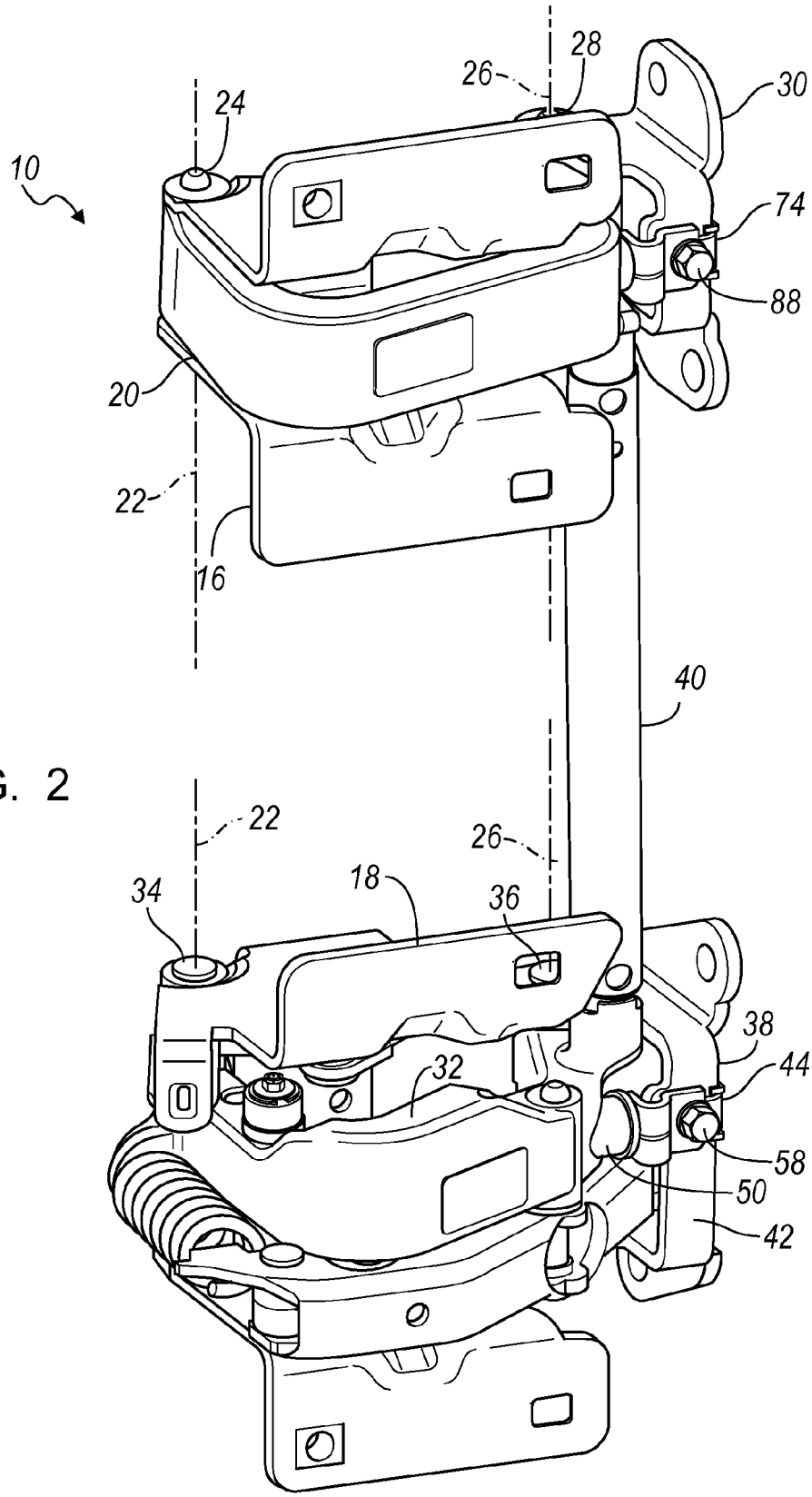
FIG. 2 is a side perspective view of the door hinge assembly of FIG. 1, looking outboard, with the door in its closed position.

FIGS. 1 and 2 show a door hinge assembly 10 secured to a rear door 12 of an extended cab pickup truck and to the body 14 of the cab. The assembly 10 includes an upper body-side hinge strap 16 and a lower body-side hinge strap 18 spaced vertically from the upper body-side hinge strap 16. Each body-side hinge strap 16, 18 has a channel cross section and outstanding flanges that are bolted to the body 14.

The upper body-side hinge strap 16 supports an upper hinge mid-strap 20, which pivots at one end about the axis 22 of a pin 24 secured to the upper body-side hinge strap 16, and pivots near its opposite end about an axis 26 of a pin 28. The pin 28 is carried on an upper door-side hinge strap 30, secured to the door 12. Similarly, the lower body-side hinge strap 18 supports a lower hinge mid-strap 32, which pivots at one end about the axis 22 at a pin 34 secured to the lower body-side hinge strap 18, and pivots near its opposite end about the axis 26 at a pin 36. The pin 36 is carried on a lower door-side hinge strap 38 secured to the door 12.

A tube 40 interconnects the upper and lower hinge mid-straps 20, 32, such that their angular movement is coordinated mutually.

Figure 3:
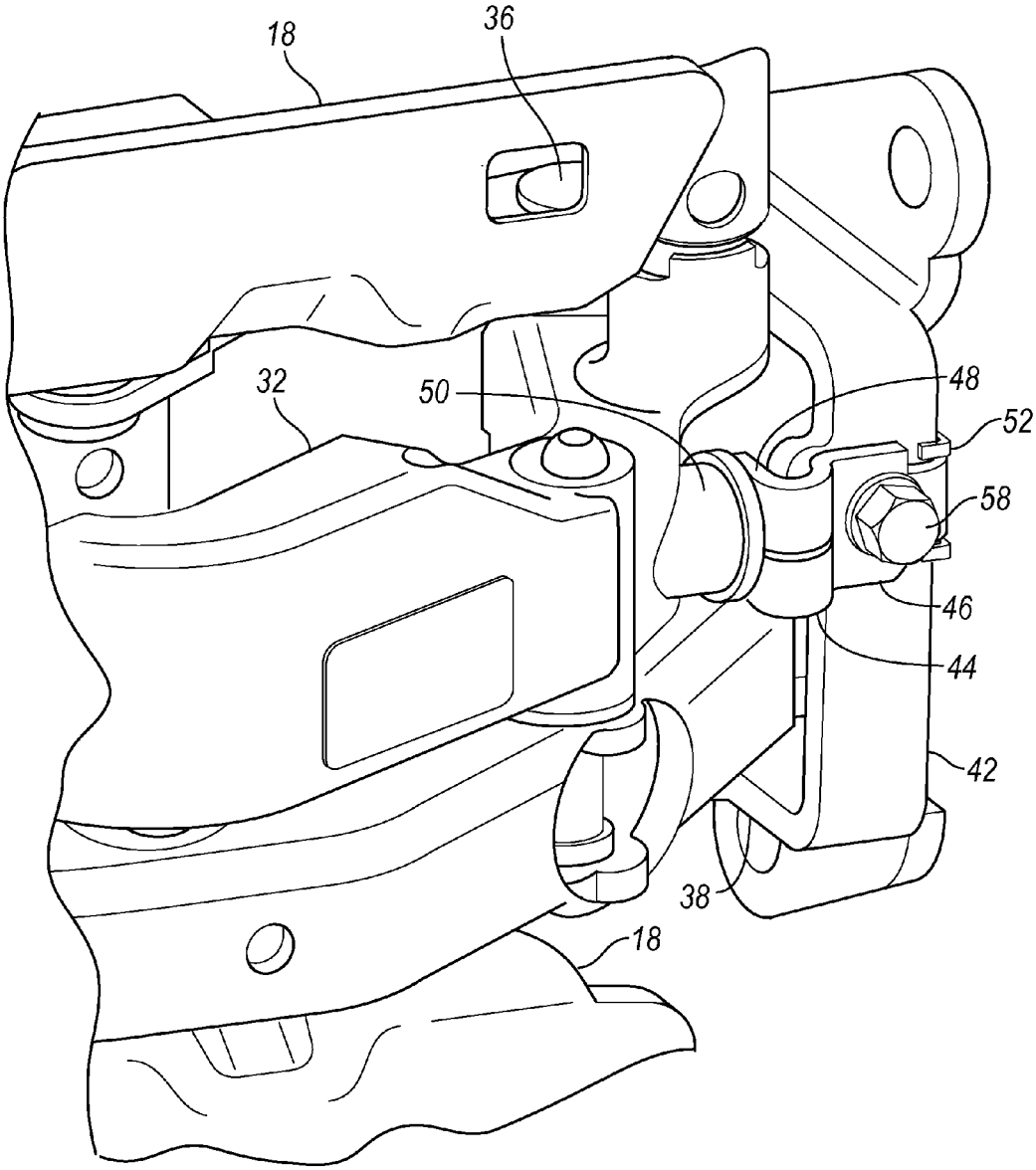
FIG. 3 is a side perspective view of the lower portion of the door hinge assembly of FIG. 1, looking outboard, with the door in its closed position.
Figure 4:
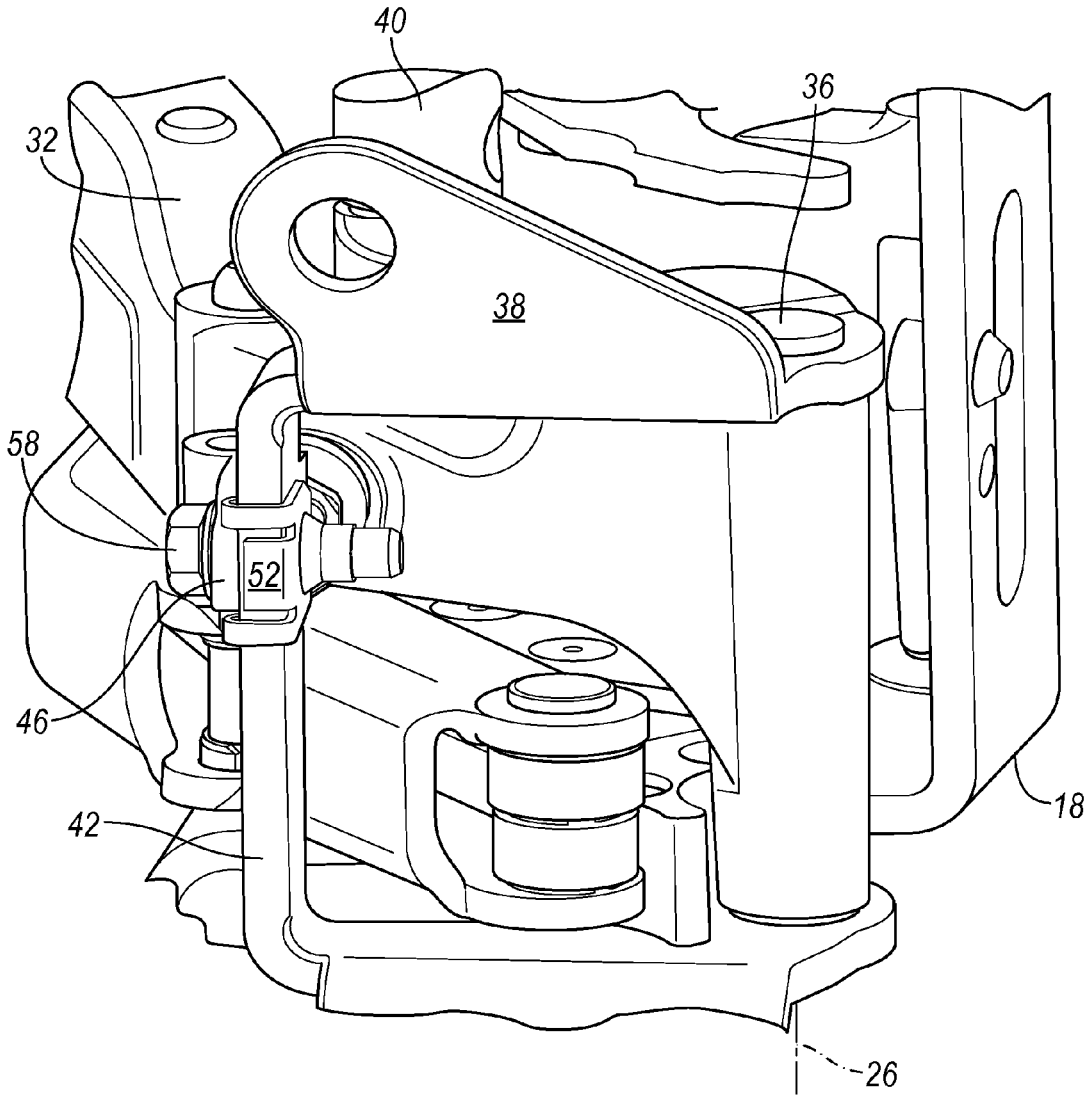
FIG. 4 is a side perspective view of the lower portion of the door hinge assembly of FIG. 1, looking inboard.
Figure 5:
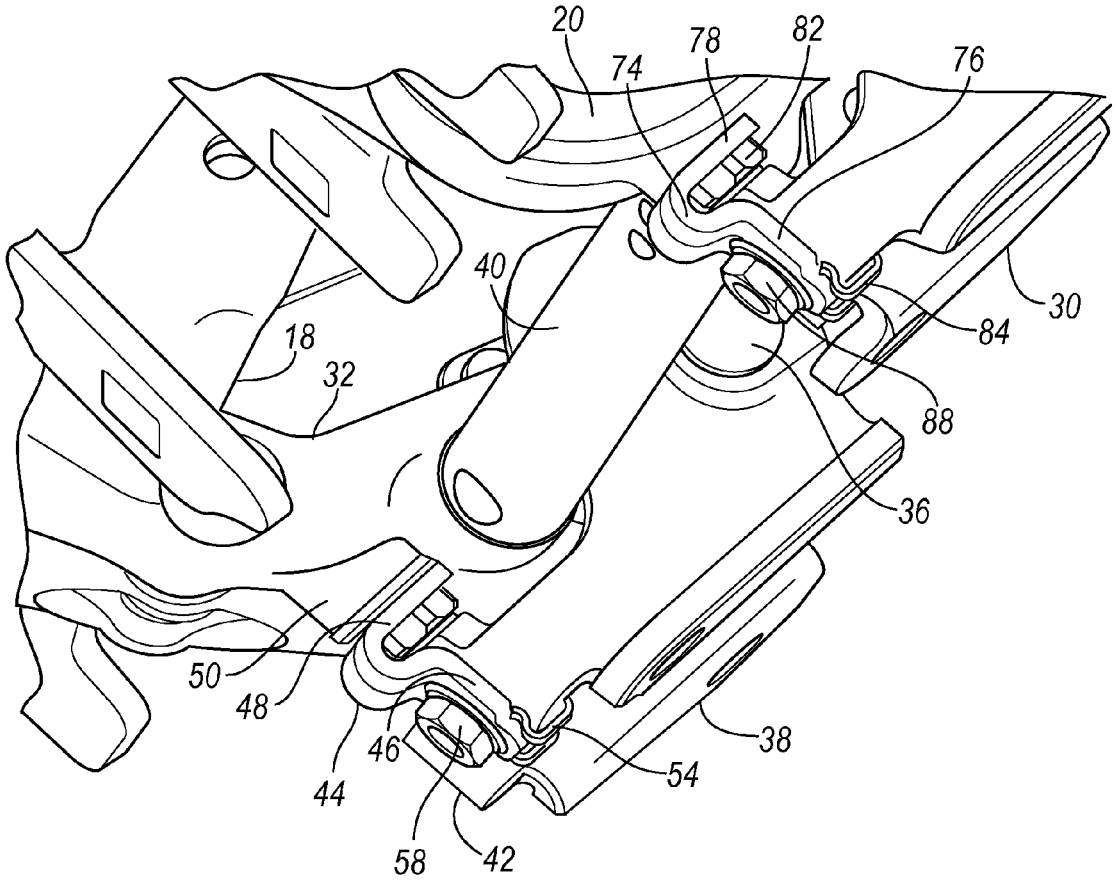
FIG. 5 is a top perspective view of the door hinge assembly of FIG. 1.

As FIGS. 3-5 show, the lower door-side hinge strap 38 is formed with an arm 42, which extends vertically and has a rectangular cross section. A lower lockout bracket 44 includes a first leg 46, which contacts the outer surface of the arm 42 of the lower door-side hinge strap 38, and a second leg 48, which is arranged substantially perpendicular to the leg 46 and faces the lower hinge mid-strap 32. The lower hinge mid-strap 32 is formed with a protrusion 50, which is connected by a bolt assembly 52 to the leg 48 of the lower lockout bracket 44.

A J-nut 54 is secured to the arm 42 of the lower door-side hinge strap 38 by tangs that elastically engage the outer and inner surfaces of the arm 42. The J-nut 54 is aligned with a hole through the thickness of the arm 42 of the lower door-side hinge strap 38 and a hole through the leg 46 of the lockout bracket 44. A bolt 58, fitted through these holes, connects the lower lockout bracket 44 to the lower door-side hinge strap 38. In this way, the lower hinge mid-strap 32 is connected by the lower lockout bracket 44 to the lower door-side hinge strap 38, thereby preventing articulation of the door 12 about the axis 26.

Figure 6:
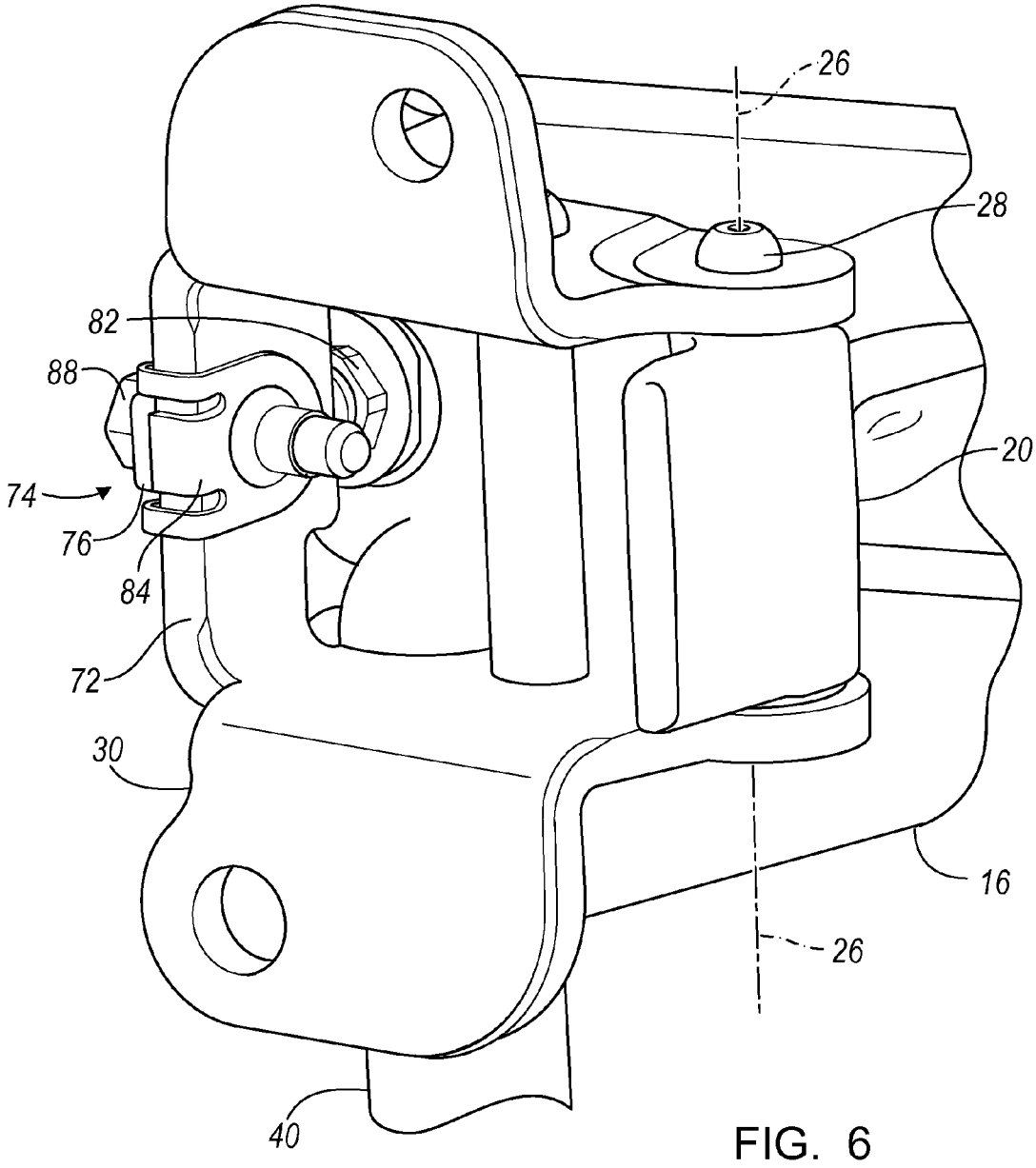
FIG. 6 is a side perspective view of the upper portion of the door hinge assembly of FIG. 1, looking inboard.

As FIGS. 5 and 6 illustrate, the upper door-side hinge strap 30 is formed with an arm 72, which extends vertically and has a rectangular cross section. An upper lockout bracket 74 includes a first leg 76, which contacts the outer surface of the arm 72 of the upper door-side hinge strap 30, and a second leg 78, which is arranged substantially perpendicular to the leg 76 and faces the upper hinge mid-strap 20. The upper hinge mid-strap 20 is connected by a bolt 82 to the leg 78 of the upper lockout bracket 74.

A J-nut 84 is secured to the arm 72 of the upper door-side hinge strap 30 by tangs, which elastically engage the outer and inner surfaces of the arm 72. The J-nut 84 is aligned with a hole through the thickness of the arm 72 of the upper door-side hinge strap 30 and a hole through the leg 76 of the upper lockout bracket 74. A bolt 88, fitted through these holes, connects the lockout bracket 74 to the upper door-side hinge strap 30. In this way, the upper hinge mid-strap 20 is connected by the lockout bracket 74 to the upper door-side hinge strap 30.

In operation, as the door 12 is opened from the closed position shown in FIG. 2 to the open position shown in FIG. 1, the upper and lower door-side hinge straps 30, 38 rotate about 90 degrees counterclockwise about the axis 22 until the upper and lower mid straps 20, 32 are located as shown in FIG. 1, i.e., at the limit of their angular displacement about the axis 22. This initial pivoting locates the door 12 approximately perpendicular to the longitudinal axis of the vehicle.

If the lockout brackets 44, 74 were absent from the hinge assembly 10, the door 12 could be opened further by a secondary pivoting of the door-side hinge straps 30, 38 through about 80 additional degrees about the axis 26, thereby fully opening the door 12 and locating a door panel (not shown) nearly parallel to the longitudinal axis of the vehicle.

But the upper and lower lockout brackets 44, 74, secure the door-side hinge straps 30, 38 to the body-side hinge straps 16, 18, thereby preventing the secondary pivoting about the axis 26. This prevents the door panel from striking a body panel of a wide body (not shown) that is located behind the cab and extends laterally beyond the width of the cab.

While certain embodiments of the present invention have been described in detail, those familiar with the art to which this invention relates will recognize various alternative designs and embodiments for practicing the invention as defined by the following claims.

What is claimed is:

1. A hinge assembly for supporting a door that provides access to the interior of a motor vehicle body comprising:

a body-side hinge strap secured to the body and providing a first axis;

a door-side hinge strap secured to the door and providing a second axis spaced from the first axis;

a hinge mid-strap supported on the body-side hinge strap to pivot about the first axis, and supported on the door-side hinge strap at the second axis; and a removable lockout bracket secured to the door-side hinge strap by a first attachment and secured to the hinge mid-strap by a second attachment preventing the door from pivoting about the second axis during use.

2. The hinge assembly of claim 1 wherein the lockout bracket is secured to the hinge mid-strap at a location along a length of the hinge mid-strap between the first axis and the second axis.

3. The hinge assembly of claim 1 wherein the hinge mid-strap is supported on the body-side hinge strap to pivot about the first axis through a range of angular displacement that extends between a first position at which the door is closed and a second position at which the door is open.

4. The hinge assembly of claim 3 wherein the range of angular displacement is about ninety degrees.

5. The hinge assembly of claim 1 wherein the lockout bracket further comprises a first leg secured to the door-side hinge strap by the first attachment, and a second leg secured to the hinge mid-strap by the second attachment.

6. The hinge assembly of claim 1 further comprising:

a nut elastically supported on the door-side hinge strap and aligned with an attachment position on the door-side hinge strap;

a first attachment and a second attachment; and wherein the lockout bracket further comprises a first leg secured at the attachment position to the door-side hinge strap by the first attachment and the nut engaged with the first attachment, and a second leg secured to the hinge mid-strap by the second attachment.

7. A hinge assembly for supporting a door that provides access to the interior of a motor vehicle body comprising:

an upper body-side hinge strap secured to the body and including a pivot aligned with a first axis;

a lower body-side hinge strap spaced vertically from the upper body-side hinge strap, secured to the body and including a pivot aligned with the first axis;

an upper door-side hinge strap secured to the door and including a pivot aligned with a second axis that is spaced from the first axis;

a lower door-side hinge strap secured to the door and including a pivot aligned with a second axis;

a hinge mid-strap supported on one of the upper and lower body-side hinge straps to pivot about the first axis, and supported on one of the upper and lower door-side hinge straps at the second axis; and a first removable lockout bracket secured by a first attachment to said one of the upper and lower door-side hinge straps, and secured by a second attachment to the hinge mid-strap preventing the door from pivoting about the second axis during use.

8. The hinge assembly of claim 7 further comprising a second lockout bracket secured to the other one of the upper and lower door-side hinge straps and secured to the hinge mid-strap continually preventing the door from pivoting about the second axis.

9. The hinge assembly of claim 7 further comprising a member interconnecting the upper and lower hinge mid-straps to coordinate angular displacement of the upper and lower hinge mid-straps about the first axis.

10. The hinge assembly of claim 7 wherein the first lockout bracket is secured to the upper hinge mid-strap at a location along a length of the upper hinge mid-strap between the first axis and the second axis.

11. The hinge assembly of claim 7 wherein:

the upper hinge mid-strap is supported on the upper body-side hinge strap to pivot about the first axis;

the lower hinge mid-strap is supported on the upper body-side hinge strap to pivot about the first axis, said pivoting occurring through a range of angular displacement that extends between a first position at which the door is closed and a second position at which the door is open.

12. The hinge assembly of claim 7 further comprising:

a first upper attachment and a second upper attachment;

a first lower attachment and a second lower attachment;

a second lockout bracket; and wherein:

the first lockout bracket further comprises a first leg secured to the upper door-side hinge by the first upper attachment, and a second leg secured to the upper hinge mid-strap by the second upper attachment; and the second lockout bracket further comprises a third leg secured to the lower door-side hinge strap by the first lower attachment, and a fourth leg secured to the lower hinge mid-strap by the second lower attachment.

13. The hinge assembly of claim 7 further comprising:

an upper nut elastically supported on the upper door-side hinge strap and aligned with an upper attachment position on the upper door-side hinge strap;

a first upper attachment and a second upper attachment;

a lower nut elastically supported on the lower door-side hinge strap and aligned with a lower attachment position on the lower door-side hinge strap;

a first lower attachment and a second lower attachment; and wherein:

the first lockout bracket further comprises a first leg secured at the upper attachment position to the upper door-side hinge strap by the first lower attachment and the upper nut engaged with the first upper attachment, and a second leg secured to the upper hinge mid-strap by the second upper attachment; and the second lockout bracket further comprises a first leg secured at the lower attachment position to the lower door-side hinge strap by the first lower attachment and the lower nut engaged with the first lower attachment, and a second leg secured to the lower hinge mid-strap by the second lower attachment.

* * * * *